US009340337B2

(12) United States Patent
Pelkey et al.

(10) Patent No.: US 9,340,337 B2
(45) Date of Patent: May 17, 2016

(54) DISPENSER WITH LOCKABLE PUSHBUTTON

(71) Applicant: Ecolab USA Inc., St. Paul, MN (US)

(72) Inventors: John T. Pelkey, St. Paul, MN (US); Brian P. Carlson, Lakeville, MN (US); Troy A. Anderson, Eagan, MN (US); Brian K. Stahel, New Brighton, MN (US)

(73) Assignee: ECOLAB USA INC., St. Paul, MN (US)

( * ) Notice: Subject to any disclaimer, the term of this patent is extended or adjusted under 35 U.S.C. 154(b) by 190 days.

(21) Appl. No.: 13/868,645

(22) Filed: Apr. 23, 2013

(65) Prior Publication Data

US 2013/0292417 A1 Nov. 7, 2013

Related U.S. Application Data

(60) Provisional application No. 61/640,890, filed on May 1, 2012.

(51) Int. Cl.

| | |
|---|---|
| ***B65D 55/10*** | (2006.01) |
| ***G05G 1/02*** | (2006.01) |
| ***E05B 1/00*** | (2006.01) |
| ***E05B 13/00*** | (2006.01) |
| *B05B 11/00* | (2006.01) |
| *A47K 5/12* | (2006.01) |

(52) U.S. Cl.

CPC ..... *B65D 55/10* (2013.01); *E05B 1/0038* (2013.01); *E05B 13/002* (2013.01); *G05G 1/02* (2013.01); *A47K 5/12* (2013.01); *B05B 11/309* (2013.01); *B05B 11/3059* (2013.01); *Y10T 74/20396* (2015.01)

(58) Field of Classification Search

CPC ..... B05B 11/309; B05B 11/3059

USPC ..... 222/153.01–153.06, 153.09, 222/153.13–153.14, 181.3, 182

See application file for complete search history.

(56) References Cited

U.S. PATENT DOCUMENTS

| | | | |
|---|---|---|---|
| 2,898,009 | A | 8/1959 | Green |
| 3,458,090 | A | 7/1969 | Scoggin, Jr. |

(Continued)

FOREIGN PATENT DOCUMENTS

| | | | |
|---|---|---|---|
| EP | 0176135 | A2 | 4/1986 |
| EP | 1454576 | A2 | 9/2004 |

(Continued)

OTHER PUBLICATIONS

International Search Report and Written Opinion of international application No. PCT/US2013/038827, dated Aug. 20, 20123, 13 pp.

(Continued)

*Primary Examiner* — Kevin P Shaver
*Assistant Examiner* — Andrew P Bainbridge
(74) *Attorney, Agent, or Firm* — Shumaker & Sieffert, P.A.

(57) ABSTRACT

A lockable pushbutton includes a locking mechanism configurable to provide a pushbutton locked position and a pushbutton unlocked position. When the locking mechanism is positioned in the locked orientation, the locking mechanism prevents actuation of the pushbutton. When the locking mechanism body is positioned in the unlocked orientation the locking mechanism permits actuation of the pushbutton.

8 Claims, 12 Drawing Sheets

(56) References Cited

U.S. PATENT DOCUMENTS

| | | | | |
|---|---|---|---|---|
| 3,971,237 | A * | 7/1976 | Rasmussen | 70/99 |
| 4,036,406 | A | 7/1977 | Jespersen et al. | |
| 4,084,729 | A | 4/1978 | Epple | |
| 4,621,749 | A | 11/1986 | Kanfer | |
| 4,673,109 | A | 6/1987 | Cassia | |
| 4,921,150 | A | 5/1990 | Lagergren et al. | |
| 4,978,036 | A | 12/1990 | Burd | |
| 5,033,657 | A | 7/1991 | Whittington | |
| 5,156,293 | A | 10/1992 | Petterson et al. | |
| 5,373,970 | A | 12/1994 | Ophardt | |
| 5,377,871 | A | 1/1995 | Banks et al. | |
| 5,431,309 | A | 7/1995 | Ophardt | |
| 5,443,236 | A | 8/1995 | Bell et al. | |
| 5,445,288 | A | 8/1995 | Banks | |
| 5,465,877 | A | 11/1995 | Bell et al. | |
| 5,492,247 | A | 2/1996 | Shu et al. | |
| 5,836,482 | A | 11/1998 | Ophardt et al. | |
| 5,992,698 | A | 11/1999 | Copeland et al. | |
| 6,036,056 | A | 3/2000 | Lee et al. | |
| 6,082,586 | A | 7/2000 | Banks | |
| 6,189,740 | B1 | 2/2001 | Wade et al. | |
| 6,209,752 | B1 | 4/2001 | Mitchell et al. | |
| 6,347,724 | B1 | 2/2002 | Chen et al. | |
| 6,516,976 | B2 | 2/2003 | Lewis et al. | |
| 6,607,103 | B2 | 8/2003 | Gerenraich et al. | |
| 6,619,512 | B1 | 9/2003 | Sayers et al. | |
| 6,701,573 | B1 | 3/2004 | Ciavarella et al. | |
| 6,707,873 | B2 | 3/2004 | Thompson | |
| 6,772,328 | B1 | 8/2004 | Talbot et al. | |
| 6,877,642 | B1 | 4/2005 | Maddox et al. | |
| 7,028,861 | B2 * | 4/2006 | Sayers et al. | 222/1 |
| 7,044,328 | B1 | 5/2006 | Ciavarella | |
| 7,066,356 | B2 | 6/2006 | Schuman et al. | |
| 7,084,592 | B2 | 8/2006 | Rodrian | |
| 7,232,045 | B2 | 6/2007 | Ophardt et al. | |
| 7,247,140 | B2 | 7/2007 | Ophardt | |
| 7,278,554 | B2 | 10/2007 | Armstrong | |
| 7,296,765 | B2 | 11/2007 | Rodrian | |
| 7,367,477 | B2 | 5/2008 | Ophardt et al. | |
| 7,497,103 | B1 * | 3/2009 | Misner | 70/103 |
| 7,530,477 | B2 | 5/2009 | Ophardt | |
| 7,540,397 | B2 | 6/2009 | Muderlak et al. | |
| 7,568,598 | B2 | 8/2009 | Ophardt et al. | |
| 7,611,030 | B2 | 11/2009 | Reynolds et al. | |
| 7,637,391 | B2 | 12/2009 | Rosenkranz et al. | |
| 7,748,574 | B2 | 7/2010 | Ophardt et al. | |
| 7,765,916 | B2 | 8/2010 | Ophardt et al. | |
| 7,798,370 | B2 | 9/2010 | Ciavarella et al. | |
| 7,798,371 | B2 | 9/2010 | Ophardt | |
| 7,896,196 | B2 | 3/2011 | Wegelin et al. | |
| 7,909,209 | B2 | 3/2011 | Reynolds et al. | |
| 7,980,777 | B2 | 7/2011 | Kennedy et al. | |
| 7,992,804 | B2 | 8/2011 | Nauels | |
| 8,245,881 | B2 | 8/2012 | Ophardt | |
| 8,251,409 | B2 * | 8/2012 | Chang et al. | 292/137 |
| 8,657,160 | B2 * | 2/2014 | Lashells et al. | 222/309 |
| 8,851,331 | B2 * | 10/2014 | Pelkey et al. | 222/181.3 |
| 2002/0074356 | A1 | 6/2002 | Lewis et al. | |
| 2003/0141318 | A1 | 7/2003 | Sorensen et al. | |
| 2004/0232168 | A1 * | 11/2004 | Ciavarella et al. | 222/156 |
| 2005/0064281 | A1 | 3/2005 | Ophardt | |
| 2005/0072808 | A1 | 4/2005 | Kitamura | |
| 2005/0263545 | A1 | 12/2005 | Ophardt | |
| 2005/0284888 | A1 * | 12/2005 | Rhodenbaugh et al. | 222/181.3 |
| 2006/0032871 | A1 | 2/2006 | Ophardt et al. | |
| 2006/0041197 | A1 | 2/2006 | Ophardt | |
| 2006/0175353 | A1 | 8/2006 | Ophardt et al. | |
| 2006/0213929 | A1 * | 9/2006 | Ophardt et al. | 222/180 |
| 2007/0000941 | A1 | 1/2007 | Hadden et al. | |
| 2007/0158359 | A1 | 7/2007 | Rodrian | |
| 2007/0169576 | A1 | 7/2007 | Ophardt et al. | |
| 2007/0257058 | A1 | 11/2007 | Ophardt et al. | |
| 2008/0121659 | A1 | 5/2008 | Ophardt | |
| 2008/0185399 | A1 | 8/2008 | Yang et al. | |
| 2008/0283556 | A1 | 11/2008 | Snodgrass et al. | |
| 2009/0045221 | A1 | 2/2009 | Ophardt et al. | |
| 2009/0101671 | A1 | 4/2009 | Cittadino et al. | |
| 2009/0120950 | A1 | 5/2009 | Titas et al. | |
| 2009/0184137 | A1 | 7/2009 | O'Brien | |
| 2009/0204256 | A1 | 8/2009 | Wegelin | |
| 2009/0266842 | A1 | 10/2009 | Snodgrass | |
| 2009/0302061 | A1 | 12/2009 | Ophardt | |
| 2009/0302067 | A1 | 12/2009 | Hendrickx et al. | |
| 2009/0308887 | A1 | 12/2009 | Woo et al. | |
| 2010/0012679 | A1 | 1/2010 | Brownlee | |
| 2010/0059550 | A1 | 3/2010 | Ciavarella et al. | |
| 2010/0072227 | A1 * | 3/2010 | Cittadino et al. | 222/153.03 |
| 2010/0140297 | A1 | 6/2010 | Ophardt et al. | |
| 2010/0147890 | A1 | 6/2010 | Ciavarella | |
| 2010/0163580 | A1 | 7/2010 | Ophardt et al. | |
| 2010/0206909 | A1 | 8/2010 | O'Brien | |
| 2010/0237096 | A1 | 9/2010 | Wegelin | |
| 2010/0252568 | A1 | 10/2010 | Ciavarella et al. | |
| 2010/0288788 | A1 | 11/2010 | Ophardt | |
| 2010/0308076 | A1 | 12/2010 | Snodgrass | |
| 2010/0320227 | A1 | 12/2010 | Reynolds | |
| 2011/0011890 | A1 | 1/2011 | Rosenkranz et al. | |
| 2011/0017778 | A1 | 1/2011 | Kadiks et al. | |
| 2011/0056987 | A1 * | 3/2011 | Proper et al. | 222/153.13 |
| 2011/0062182 | A1 | 3/2011 | Reynolds | |
| 2011/0101032 | A1 | 5/2011 | Hsu | |
| 2012/0006848 | A1 | 1/2012 | Reynolds | |
| 2012/0080452 | A1 | 4/2012 | Boshuizen et al. | |

FOREIGN PATENT DOCUMENTS

| | | | |
|---|---|---|---|
| EP | 1280448 | B1 | 2/2008 |
| EP | 20055871 | A2 | 12/2008 |
| EP | 2223642 | A2 | 9/2010 |
| JP | 2000023871 | A | 1/2000 |
| WO | 9420407 | A1 | 9/1994 |
| WO | 0249490 | A1 | 6/2002 |
| WO | 2004086731 | A2 | 10/2004 |
| WO | 2008006209 | A2 | 1/2008 |
| WO | 2011077111 | A1 | 6/2011 |

OTHER PUBLICATIONS

U.S. Appl. No. 13/869,205, by John T. Pelkey, filed Apr. 24, 2013.
U.S. Appl. No. 13/769,155, by John T. Pelkey, filed Feb. 15, 2013.
U.S. Appl. No. 13/768,110, by John T. Pelkey, filed Feb. 15, 2013.

* cited by examiner

DISPENSER WITH LOCKABLE PUSHBUTTON

This application claims the benefit of U.S. Provisional Application No. 61/640,890, filed May 1, 2012, which is incorporated herein by reference in its entirety.

TECHNICAL FIELD

The disclosure relates to dispensers and lockable pushbuttons.

BACKGROUND

Hand washing is important in many industries, including hospitality (hotels, restaurants, etc.) and healthcare (hospitals, nursing homes, etc.). To facilitate hand washing, hand soap dispensers are placed near sinks for the washing of hands by employees of such establishments. In addition, public restrooms typically include hand soap dispensers used by patrons of an establishment, patients of a healthcare facility, or other members of the public. These dispensers house a disposable or refillable product container, such as a cartridge or flexible bag, containing a supply of the desired soap product. The soaps may include foam, liquid and/or gel hand soaps. The dispensers are generally wall mounted and include a hinged cover which permits opening and closing of the dispenser housing so that the supply of soap may be refilled or replaced. Some hand soap dispensers are manually actuated by pushing or pulling a handle, bar, or button on the dispenser. Others dispense automatically by sensing presence of a user's hands near the dispenser.

SUMMARY

In general, the disclosure relates to lockable pushbuttons. The lockable pushbuttons may be used with any application, such as a hand soap dispenser or other application in which a lockable pushbutton may be desirable. A locking mechanism is configurable to provide a pushbutton locked position and a pushbutton unlocked position. When the locking mechanism is positioned in a locked orientation, the locking mechanism prevents actuation of the pushbutton. When the locking mechanism body is positioned in an unlocked orientation, the locking mechanism permits actuation of the pushbutton.

In one example, the disclosure is directed to a lockable pushbutton, comprising a locking mechanism body having a locked orientation and an unlocked orientation, a locking mechanism receiving area sized to receive the locking mechanism in either the locked orientation or the unlocked orientation, and an actuatable pushbutton, such that when the locking mechanism body is received into the locking mechanism receiving area in the locked orientation, the locking mechanism prevents actuation of the pushbutton, and when the locking mechanism body is received into the locking mechanism receiving area in the unlocked orientation, the locking mechanism permits actuation of the pushbutton.

In another example, the disclosure is directed to a housing including a back plate and an openable front cover, a container inside of the housing having a supply of fluid to be dispensed, a dispensing actuator that when actuated by a user results in a quantity of the fluid being dispensed from the container, a locking mechanism body having a locked orientation and an unlocked orientation, the housing further including a locking mechanism receiving area positioned inside of the housing and sized to receive the locking mechanism in either the locked orientation or the unlocked orientation, and a lockable pushbutton that upon actuation depresses a latch inside of the housing thus allowing the front cover to be opened, such that when the locking mechanism body is received into the locking mechanism receiving area in the locked orientation, the locking mechanism prevents actuation of the pushbutton, and when the locking mechanism body is received into the locking mechanism receiving area in the unlocked orientation, the locking mechanism permits actuation of the pushbutton.

In another example, the disclosure is directed to a lockable pushbutton comprising a housing including a pushbutton receiving area having a base and substantially vertical sidewalls, the base further including an aperture and a slot, the slot having a locking detent at a first end and an unlocking detent at a second end, a locking stop including a stop body having a first interlock post at a first end and a second interlock post at a second end, wherein first interlock post fits into the aperture and the second interlock post fits into the slot such that second interlock post is movable within the slot between the locking detent and the unlocking detent, and an actuatable pushbutton sized to fit within pushbutton receiving area, the aperture and the slot positioned within the base such that when the second interlock posts is positioned in the locking detent, the stop body blocks the aperture and prevents actuation of the pushbutton.

In another example, the disclosure is directed to a dispenser, comprising a housing including a back plate and an openable front cover, a container inside of the housing having a supply of fluid to be dispensed, a dispensing actuator that when actuated by a user results in a quantity of the fluid being dispensed from the container, the housing further including a pushbutton receiving area having a base and substantially vertical sidewalls, the base further including an aperture and a slot, the slot having a locking detent at a first end and an unlocking detent at a second end, a locking stop including a stop body having a first interlock post at a first end and a second interlock post at a second end, wherein first interlock post fits into the aperture and the second interlock post fits into the slot such that second interlock post is movable within the slot between the locking detent and the unlocking detent, and an actuatable pushbutton sized to fit within pushbutton receiving area the aperture and the slot positioned within the base such that when the second interlock posts is positioned in the locking detent, the stop body blocks the aperture and prevents actuation of the pushbutton.

The details of one or more examples are set forth in the accompanying drawings and the description below. Other features and advantages of the invention will be apparent from the description and drawings, and from the claims.

DETAILED DESCRIPTION

Figure 1:
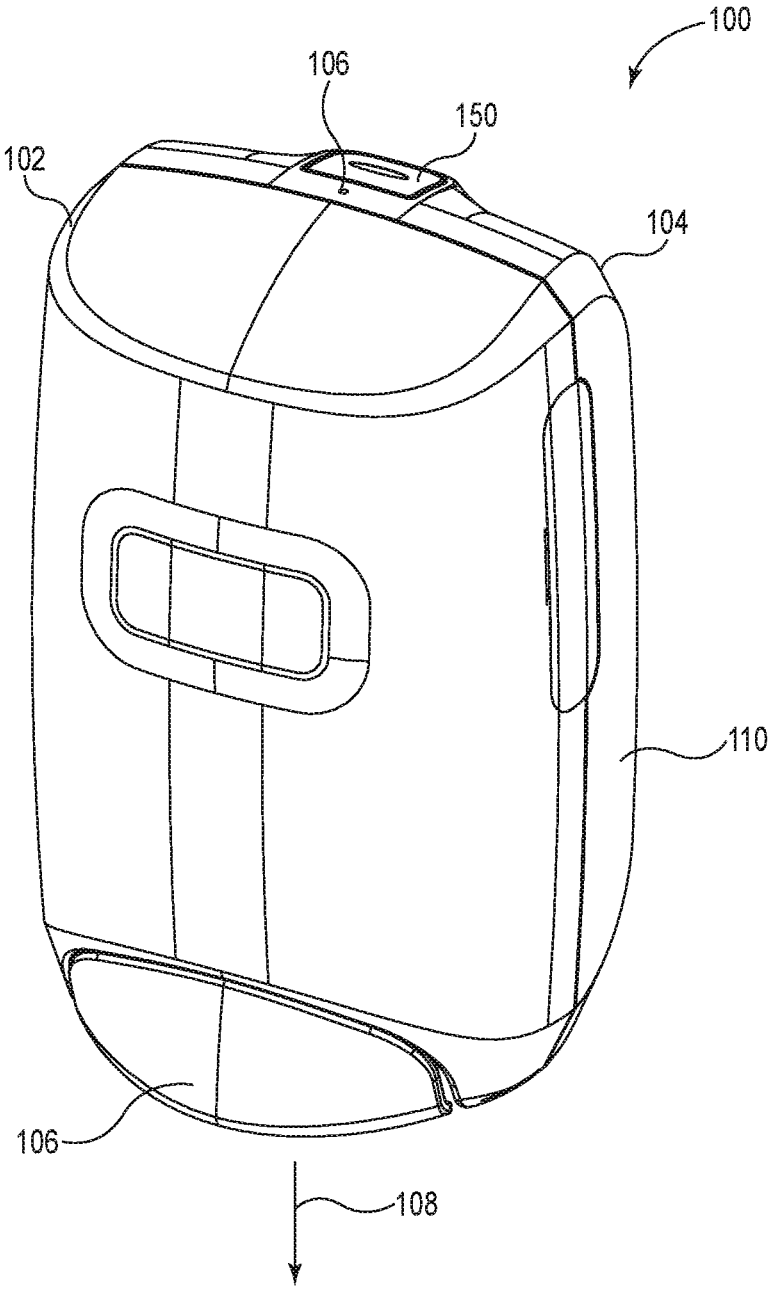
FIG. 1 is a front perspective view of an example hand soap dispenser having a lockable pushbutton.

FIG. 1 is a front perspective view of an example hand soap dispenser 100 having a lockable pushbutton 150. Example dispenser 100 includes a housing 110 having a front cover 102 and a back plate 104. Back plate 104 facilitates mounting of dispenser 100 to a wall or other object. In this example, housing 110 includes a hinge or hinges 112 which permit cover 102 to pivot between a closed position and an open position.

Hand soap dispensers, such as example dispenser 100, are generally placed near sinks in kitchens, hospitals, restrooms, or other locations to facilitate hand washing by employees, members of the public, or other users. In some applications, it may be desirable to provide a hand soap dispenser that prevents such users from opening the dispenser housing and obtaining access to the interior of the dispenser. This may help to prevent theft of the product supply container, and/or tampering with the product supply or the inner workings of dispenser 100.

In other applications, various fluids may be dispensed using a manual or automatic dispenser. The fluid to be dispensed may include, for example, one or more of a hand soap, a lotion, a sanitizer, a disinfectant, or any type of cleaning agent. The fluid to be dispensed may also include one or more of a detergent, a bleach, or other type of laundry product. In general, the lockable pushbutton(s) described herein may be used in any application in which a lockable pushbutton may be desired, and the disclosure is not limited in this respect.

Example dispenser 100 is provided with a lockable pushbutton 150. Lockable pushbutton 150 includes a locking mechanism (not shown in FIG. 1) configurable to provide lockable pushbutton 150 with two positions: a locked position and an unlocked position. In the unlocked position, actuation of lockable pushbutton 150 depresses a cover latch within the housing, thus permitting opening of cover 102. In this way, the soap supply within the dispenser housing 110 may be changed or refilled as desired. In the locked position, actuation of lockable pushbutton 150 is prevented, thus preventing depression of the latch and therefore preventing opening of the housing. In this example, housing 110 further includes a keyhole 106. To open cover 102 when lockable pushbutton 150 is in the locked position, a key (not shown in FIG. 1) may be inserted into keyhole 106 to deflect the cover latch and permit dispenser 100 to be opened.

Figure 2:
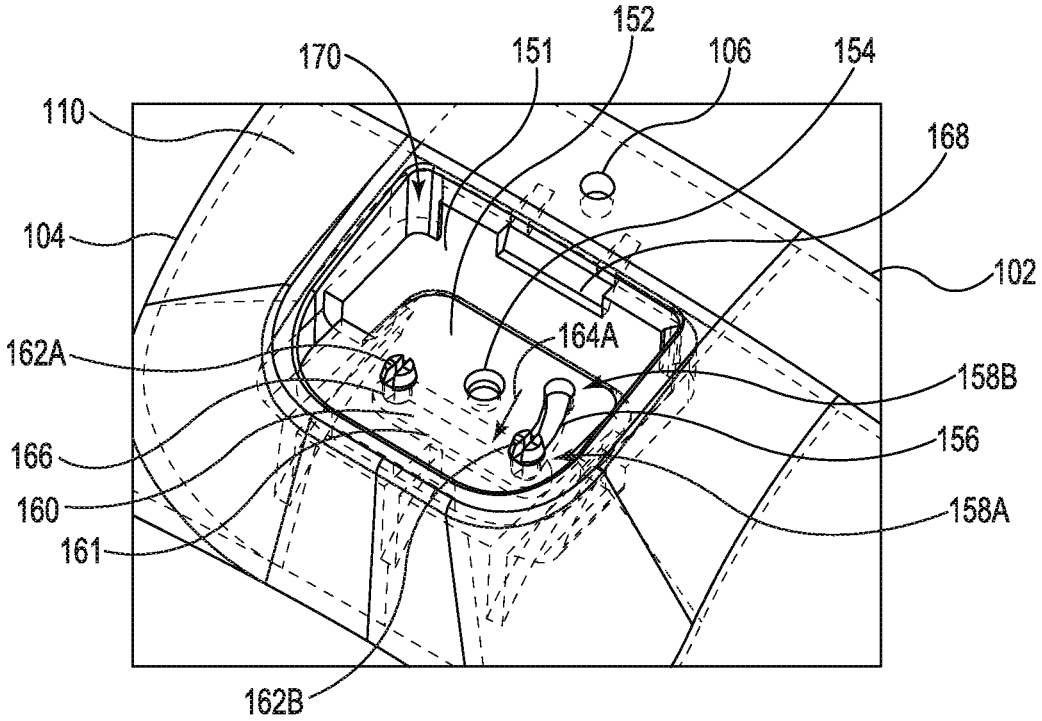
FIG. 2 is a top view of an example dispenser showing an example implementation of a lockable pushbutton in an unlocked position.
Figure 3:
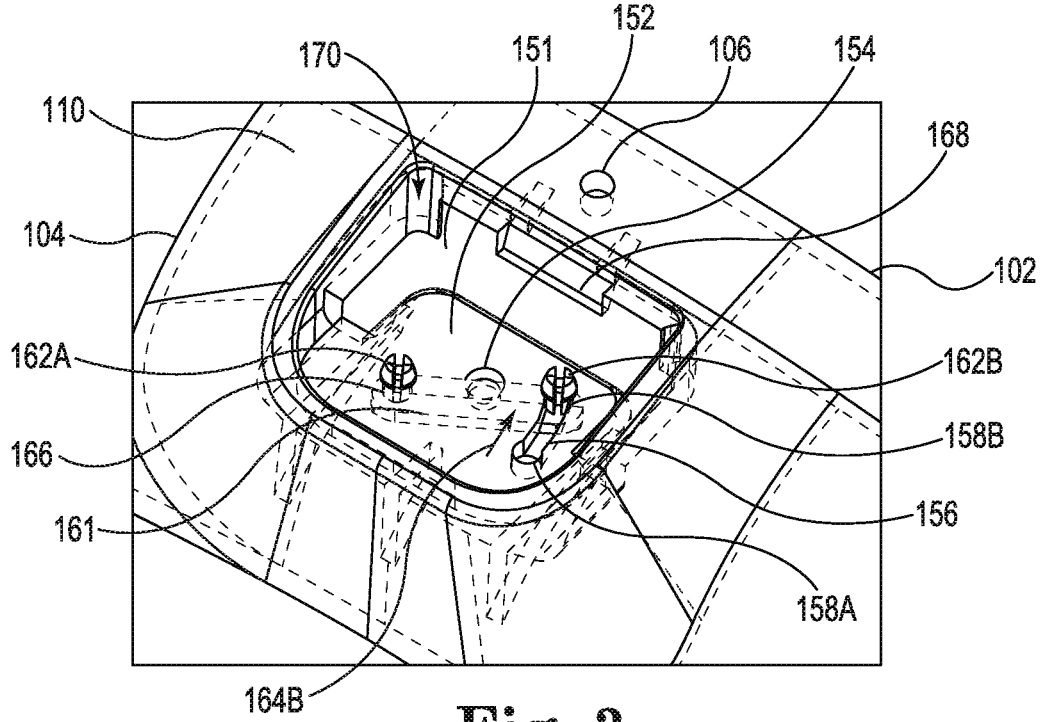
FIG. 3 is a top view of an example dispenser showing an example implementation of a lockable pushbutton in a locked position.

FIG. 2 is a top view of an example hand soap dispenser 100 showing an example implementation of a locking mechanism for a lockable pushbutton in an unlocked position. FIG. 3 is a top view of an example hand soap dispenser 100 showing an example implementation of a locking mechanism for a lockable pushbutton in a locked position. For purposes of description, the pushbutton itself is not shown in FIGS. 2 and 3.

Housing 110 of dispenser 100 includes, as discussed above, a cover 102 and a back plate 104. A catch 168, in combination with a latch on cover 102, holds cover in a closed position with respect to back plate 104. Housing 110 further includes a pushbutton receiving area 170 having sidewalls 151 and a base 152. Base 152 includes an aperture 154 and a slot 156. Slot 156 includes a detent 158A at a first end and a detent 158B at a second end. A locking stop 160 includes a stop body 161 having a first interlock post 162A at a first end and a second interlock post 162B at a second end. First interlock post 162A fits into an interlock aperture 166 in base 152. Second interlock post 162B fits into slot 156. As such, locking stop 160 may rotate between the unlocked position shown in FIG. 2 and the locked position shown in FIG. 3. When in the locked position (detent 158B) shown in FIG. 2, stop body 161 is positioned under base 152 and in a location that does not block aperture 154. When in the locked position (detent 158A) shown in FIG. 3, stop body 161 is positioned below aperture 154 in a location that blocks aperture 154 and provides the locking feature for lockable pushbutton 150 as will be described further below.

In this example, first and second interlock posts 162A and 162B are flexible so that they may be fit into interlock aperture 166, and slot 156. The flexible interlock posts 162B permits locking body 160 to rotate between the unlocked and locked positions (e.g., detents 158A and 158B, respectively) and provide positive feedback to the user that the stop is correctly placed in either the locked or the unlocked position.

The lockable pushbutton shown in FIGS. 2 and 3 may be locked or unlocked without the need to add or remove any internal or external parts. This helps to reduce the complexity of the lockable pushbutton and may reduce the risk of losing loose separate components. In addition, this example of a lockable pushbutton is intuitive to use, in that locking stop 160 may be rotated to either lock or unlock the dispenser. The flexible interlock posts 162A and 162B and detents 158A and 158B may also help to reduce the likelihood that the dispenser may be accidently locked or unlocked. In addition, the lockable pushbutton design shown in FIGS. 2 and 3 has a minimal footprint, and therefore has a minimal, if any, influence on the overall size and shape of dispenser 100.

Figure 4:
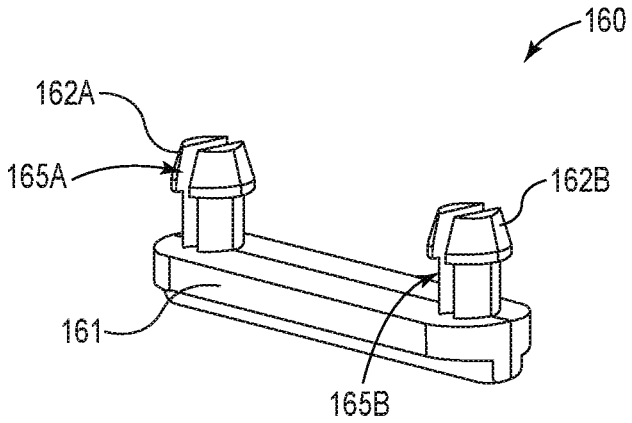
FIG. 4 is a perspective view showing an example stop design for a lockable pushbutton.

FIG. 4 is a perspective view showing an example implementation for the locking stop 160 shown in FIGS. 2 and 3. As discussed above, locking stop 160 includes stop body 161 and interlock posts 162A and 162B. In this example, interlock posts 162A and 162B are made flexible by inclusion of flexibility slots 165A and 165B, respective. Slots 165A and 165B permit interlock posts 162A and 162B to flex inwardly and outwardly during insertion into interlock aperture 166 and slot 156, and into detents 158A and 158B. Although in this example interlock posts 162A and 162B include slots, other mechanisms for providing flexible interlock posts may also be used, and the disclosure is not limited in this respect. For example, interlock posts 162A and/or 162B may be fabricated using a flexible material rather than or in addition to having slots. Those skilled in the art will readily recognize that interlock posts may be made flexible in any of a number of ways, and that the disclosure is not limited in this respect. In addition, rather than flexible interlock posts, the interlock aperture 166 and/or slot 156 may alternatively or in addition to, be made flexible so as to provide one or more of the features described herein.

Figure 5:
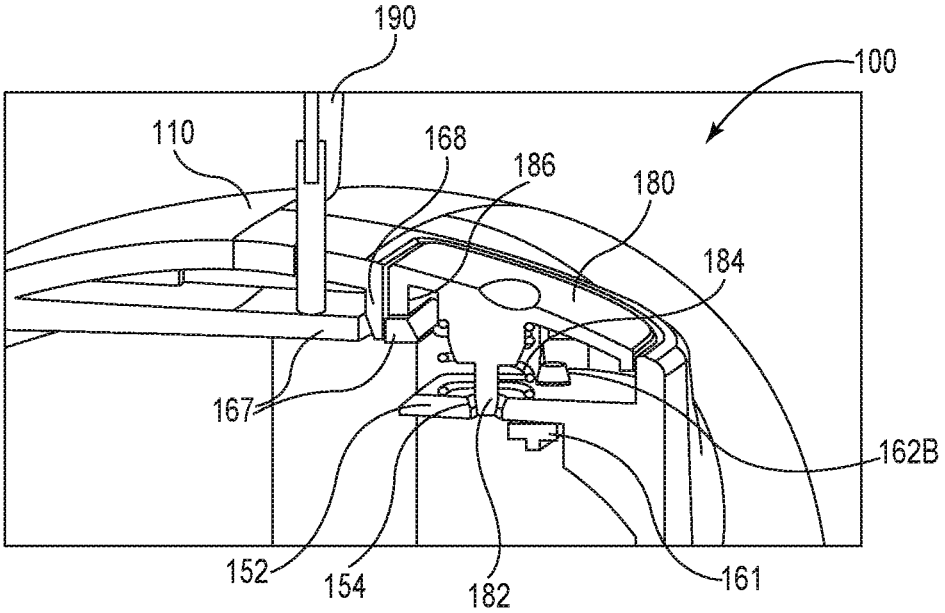
FIG. 5 is a side section view of a dispenser showing a stop of a lockable pushbutton in an unlocked position.

FIG. 5 is a side section view of an example hand soap dispenser 100 showing a stop of a lockable pushbutton in an unlocked position. In this example, pushbutton 180 includes a tab portion 182 configured to fit within aperture 154. A spring 184 permits pushbutton 180 to be depressed downwardly from its resting, topmost position. Spring 184 also returns pushbutton 180 to its resting topmost position when the downward pressure is released. In FIG. 5, stop body 161 is rotated to an unlocked position in which stop body 161 does not block aperture 182. This permits pushbutton 180 to be depressed such that tab portion 182 extends through aperture 154 and further permitting an actuator portion 186 of pushbutton 180 to depresses latch 167, releasing catch 168 and thus allowing front cover 102 to be opened.

Figure 6:
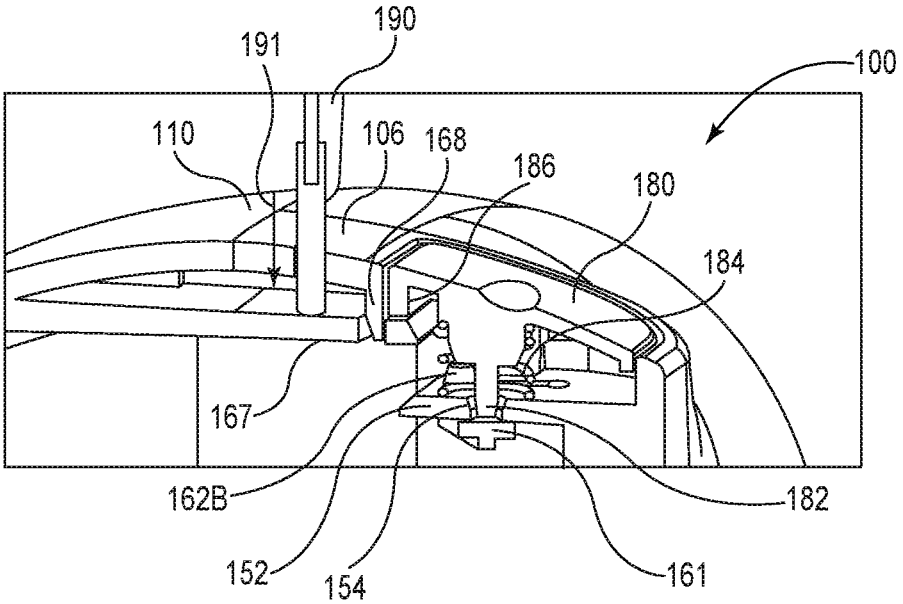
FIG. 6 is a side section view of a dispenser showing a stop of a lockable pushbutton in a locked position.

FIG. 6 is a side section view of an example hand soap dispenser 100 showing a stop of a lockable pushbutton in a locked position. In FIG. 6, stop body 161 is rotated to a locked position in which stop body 161 blocks aperture 154. This prevents pushbutton 180 from being depressed such that tab portion 182 extends through aperture 154 and further prevents actuator portion 186 from depressing latch 167. Thus, attempted actuation of pushbutton 180 is prevented, thus preventing opening of front cover 102.

FIG. 6 also shows a key 190 inserted into keyhole 106. Depression of key in the direction indicated by arrow 191 depresses latch 167, releasing catch 168 and permitting front cover 102 to be opened when lockable pushbutton is in the locked position.

Figure 7:
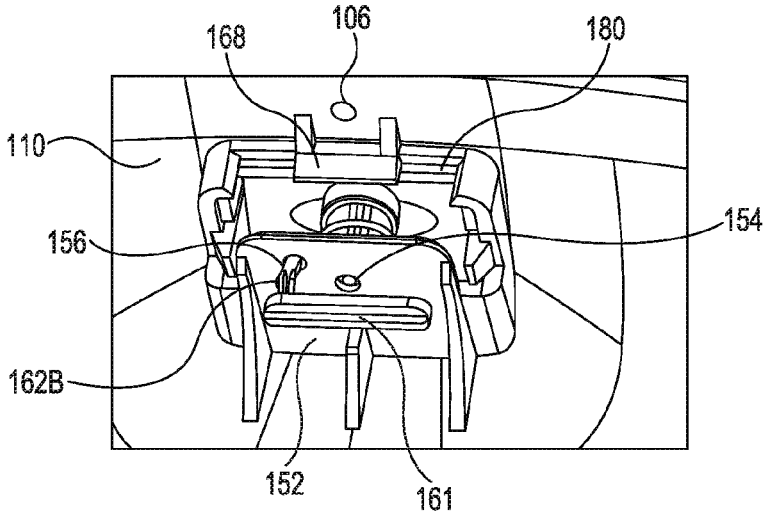
FIG. 7 is a bottom perspective view of an example lockable pushbutton having a stop in an unlocked position.
Figure 8:
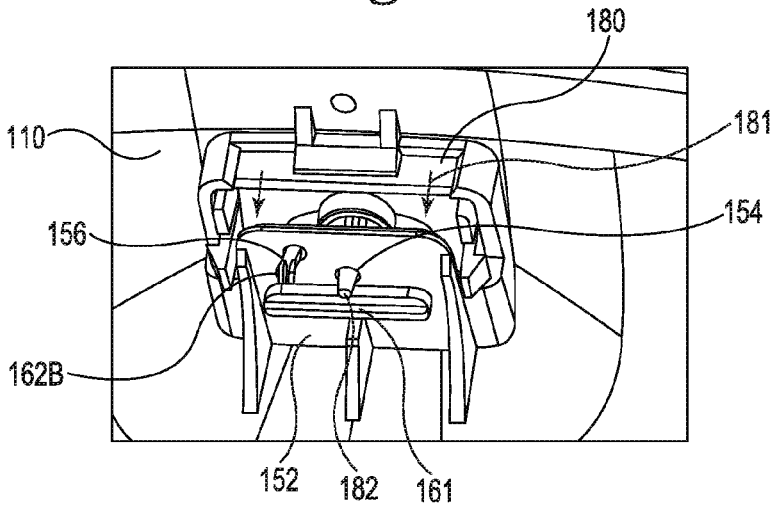
FIG. 8 is a bottom perspective view of an example lockable pushbutton having a stop in an unlocked position with the pushbutton fully depressed.

FIGS. 7 and 8 are bottom perspective views of a lockable pushbutton having a stop in an unlocked position. In these views, slot 156 is visible and stop body 161 can be seen in an unlocked position such that stop body 161 does not block aperture 154. FIG. 7 shows pushbutton 180 in its resting topmost position. FIG. 8 shows that pushbutton 180 is being depressed in the direction indicated by arrows 181, such that tab portion 182 extends through aperture 154. Depression of pushbutton 180 in this manner further permit actuator portion 186 of pushbutton 180 to depress a latch (not shown in FIGS. 7-9), releasing catch 168 and allowing front cover 102 to be opened.

Figure 9:
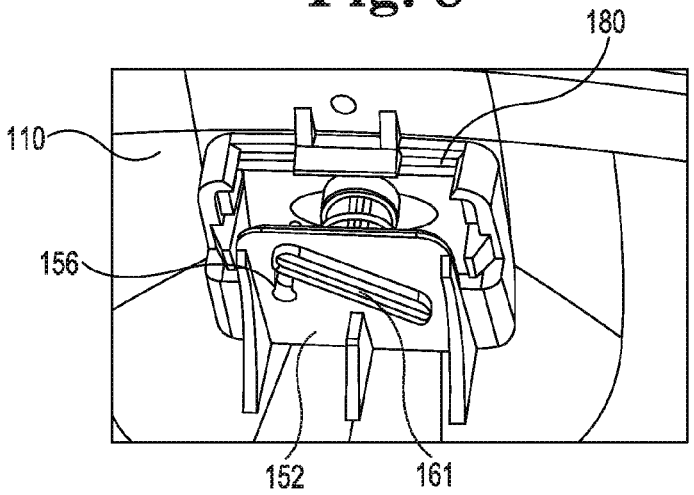
FIG. 9 is a bottom perspective view of an example lockable pushbutton having a stop in a locked position.

FIG. 9 is a bottom perspective view of a lockable pushbutton having a stop in a locked position. In FIG. 9, stop body 161 is rotated in slot 156 to a locked position in which stop body 161 blocks aperture 154. The stop body 161 prevents tab portion 182 from being depressed and extended through aperture 154. Since the pushbutton may not be depressed, this further prevents actuator portion 186 from depressing the latch (not shown). Thus, attempted actuation of pushbutton 180 is prevented, thus preventing opening of front cover 102.

Figure 10:
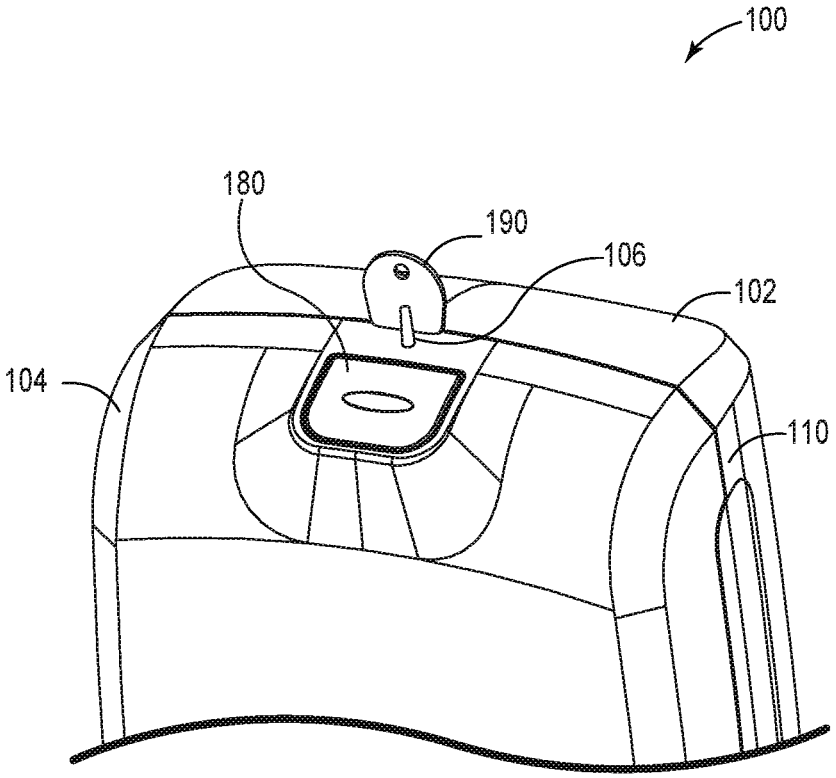
FIG. 10 is a back perspective view of an example hand soap dispenser having a lockable pushbutton with a key being inserted to unlock the cover.

FIG. 10 is a back perspective view of an example hand soap dispenser 100 having a lockable pushbutton with a key 190 being inserted in a keyhole 106 to unlock the cover 102.

Figure 11:
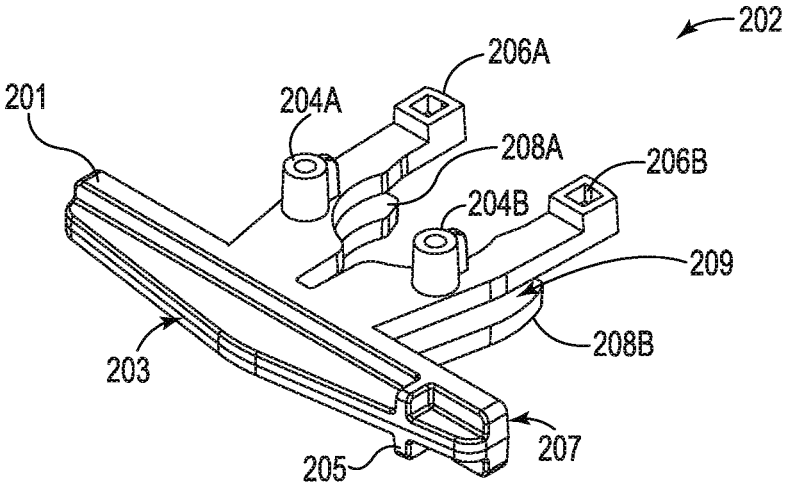
FIG. 11 is a perspective view of another example locking mechanism for a lockable pushbutton.
Figure 12:
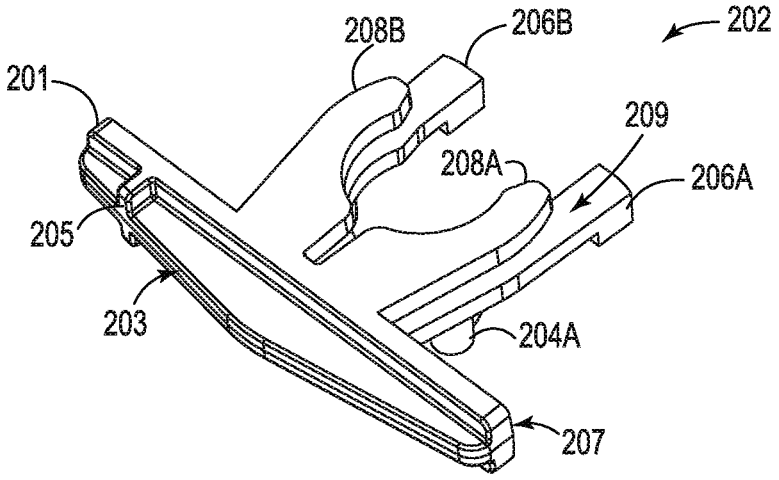
FIG. 12 is another perspective view of the example locking mechanism shown in FIG. 11.

FIG. 11 is a perspective view of another example locking mechanism 202 for a lockable pushbutton. FIG. 12 is another perspective view of the example locking mechanism 202. In this example, locking mechanism 202 is implemented as a one-piece article. Locking mechanism 202 is configured to be inserted into a corresponding locking mechanism receiving area (see, e.g., FIGS. 13 and 14) for a lockable pushbutton. Example locking mechanism 202 includes a base portion 201 having a front side 203 and a back side 207. Two spaced apart locking projections 206A and 206B extend outwardly from back side 234. Each locking projection 206A and 206B includes a locking post 204A and 204B, respectively. Locking mechanism 202 further includes two spaced apart unlocking projections 208A (not visible in FIG. 11) and 208B that also extend outwardly from back side 234 of base portion 201. Unlocking projections 208A and 208B are substantially parallel with locking projections 206A and 206B such that projections 208A-208B and 206A-206B define a receiving space 209, the purpose of which is to help fit the locking mechanism into the receiving area as described below with respect to FIGS. 17-22.

Locking mechanism 202 is configured to be insertable in two different orientations into the corresponding locking mechanism receiving area; a lock orientation and an unlock orientation. For example, to place the dispenser in a locked configuration, locking mechanism 202 may be inserted into the receiving area in an orientation in which the locking projections 206A and 206B are orientated toward the lockable pushbutton of the dispenser. That is, in this example, locking mechanism 202 would be inserted into the locking mechanism receiving area in the orientation shown in FIG. 11, with the locking posts 204A and 204B facing a generally upward direction, and with unlocking projections 208A and 208B facing a generally downward direction.

Alternatively, to place the dispenser in an unlocked configuration, locking mechanism 202 may be inserted into the receiving area in an orientation in which the unlocking projections 208A and 208B are orientated toward the lockable pushbutton of the dispenser. That is, in this example, locking mechanism 202 would be inserted into the locking mechanism receiving area in the orientation shown in FIG. 12, with unlocking projections 208A and 208B facing a generally upward direction, and with locking projections 206A and 206B and corresponding locking posts 204A and 204B, respectively, facing a generally downward direction.

In this way, example locking mechanism 202 provides a one piece design that is reversible to provide both locking and unlocking functions for a lockable pushbutton. In a first orientation (such as that shown in FIG. 11), locking mechanism may be inserted into the dispenser to provide a locking feature. If a user desires to change the dispenser from a locked configuration to an unlocked configuration, or vice versa, the user need only remove the locking mechanism 202 from the receiving area inside of the dispenser, rotate it 180°, and reinsert it in the reverse orientation (such as that shown in FIG. 12) to provide the opposite (unlocking in this example) function. The one piece design may help to reduce complexity and the risk of losing loose separate components. In addition, the design of example locking mechanism 202 is of a size and shape that would not significantly affect the size or shape of the dispenser housing.

Figure 13:
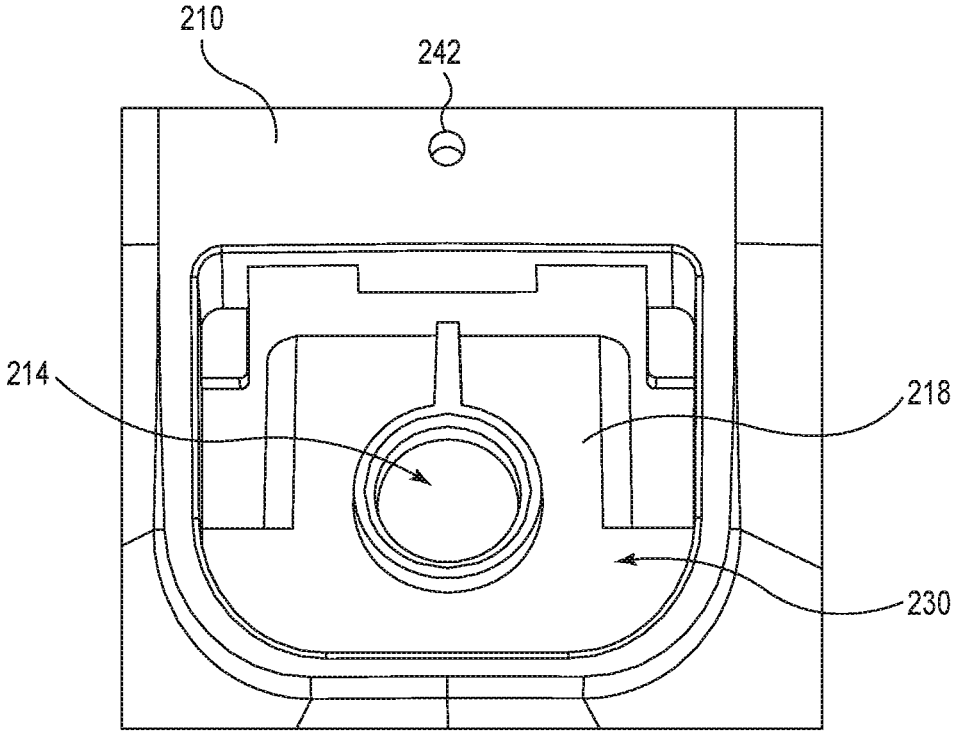
FIG. 13 is a top view of a housing having an example locking mechanism and pushbutton receiving area for a lockable pushbutton.

FIG. 13 is a top view of an example housing 210 having a locking mechanism and pushbutton receiving area 230 for a lockable pushbutton. Housing 210 may correspond with, for example, a hand soap dispenser, or other application in which a lockable pushbutton is desired. Housing 210 further includes a keyhole 242 into which a key may be inserted to unlock the housing when the lockable pushbutton (not shown in FIGS. 13 and 14) is in the locked position. Receiving area 230 further includes a base 218 having a spring receiving recess 214.

Figure 14:
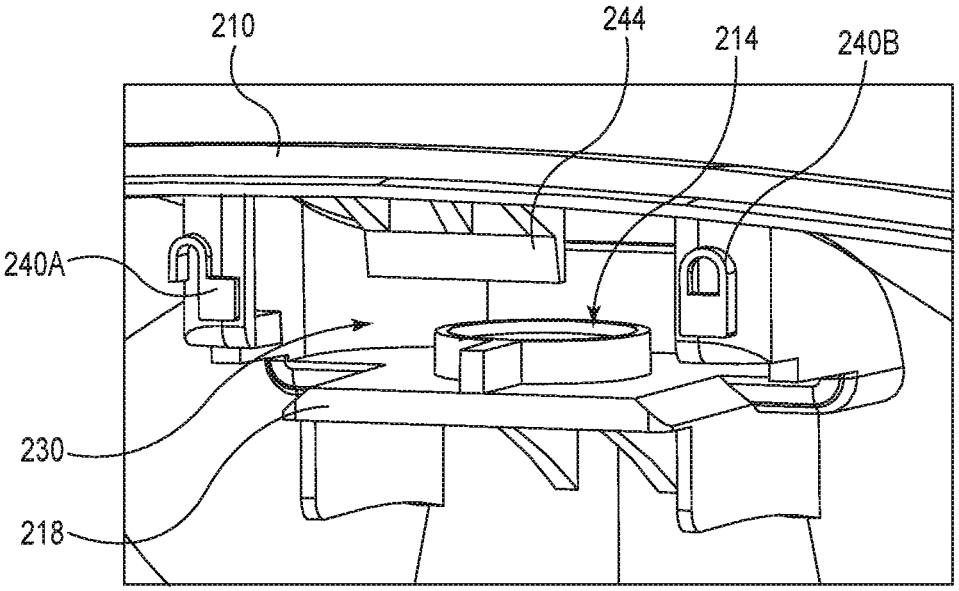
FIG. 14 is an interior perspective view of an example housing showing a locking mechanism receiving area.

FIG. 14 is an interior perspective view of an example housing 210, showing locking mechanism receiving area 230. Again, receiving area 230 includes base 218 and spring receiving recess 214. A catch 244 permits a front cover (not shown in FIG. 14) to be opened and closed as described herein. Receiving area 230 further includes orientation indicators 240A and 240B. Orientation indicators 240A and 240B are configured to align with orientation aligner 205 on locking mechanism 202. For example, when locking mechanism 202 is inserted into receiving area 230 in a locking orientation, orientation aligner 205 on locking mechanism 202 will line up with orientation indicator 240B, thus indicating to a user that locking mechanism has been inserted in a locking orientation. Alternatively, when locking mechanism 202 is inserted into receiving area 230 in an unlocking orientation, orientation aligner 205 on locking mechanism 202 will line up with orientation indicator 240A, thus indicating to a user that locking mechanism has been inserted in an unlocking orientation.

Locking mechanism 202 may be inserted into receiving area 230 such that base 218 is fitted into receiving space 209. In this example, locking projections 206A and 206B, as well as unlocking projections 208A and 208B are shaped to receive spring recess 214 when locking mechanism 220 is inserted into receiving area 230.

Figure 15:
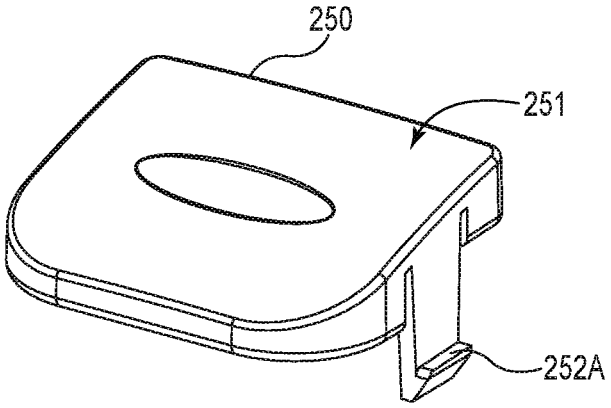
FIG. 15 is a top perspective view of an example pushbutton.
Figure 16:
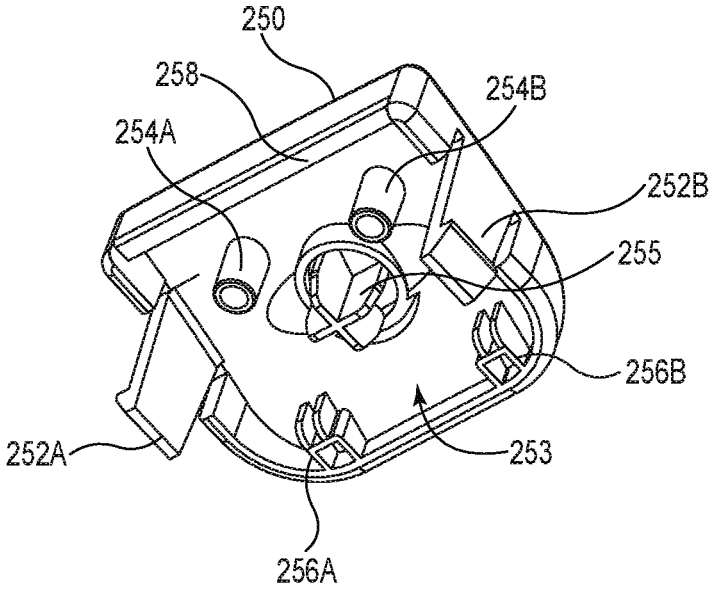
FIG. 16 is a bottom perspective view of an example pushbutton.

FIG. 15 is a top perspective view of an example pushbutton 250 for use with example locking mechanism 202. FIG. 16 is a bottom perspective view of example pushbutton 250. Pushbutton 250 includes a top surface 251 and a bottom surface 253. A user actuates pushbutton 250 by depressing top surface 251 of pushbutton 250. Bottom surface 253 of pushbutton 250 includes various features which cooperate with locking mechanism 202 to provide the locking and unlocking features for a lockable pushbutton. For example, bottom surface 253 includes downwardly extending projections 254A and 254B configured to align with locking posts 204A and 204B, respectively, of locking mechanism 202. Similarly, projections 256A and 256B are configured to align with locking projections 206A and 206B, respectively, when locking mechanism is fitted into receiving area 230 in a locking orientation. Bottom surface 253 may further include a spring guide 255 and tabs 252A and 252B that help fit pushbutton 250 into receiving area 230. Bottom surface 253 further includes an actuating surface 258 such that when pushbutton 250 is actuated, actuating surface 253 depresses a latch within housing 210 (not shown in FIGS. 16-18) releasing catch 244 permitting housing 210 to be opened.

Figure 17:
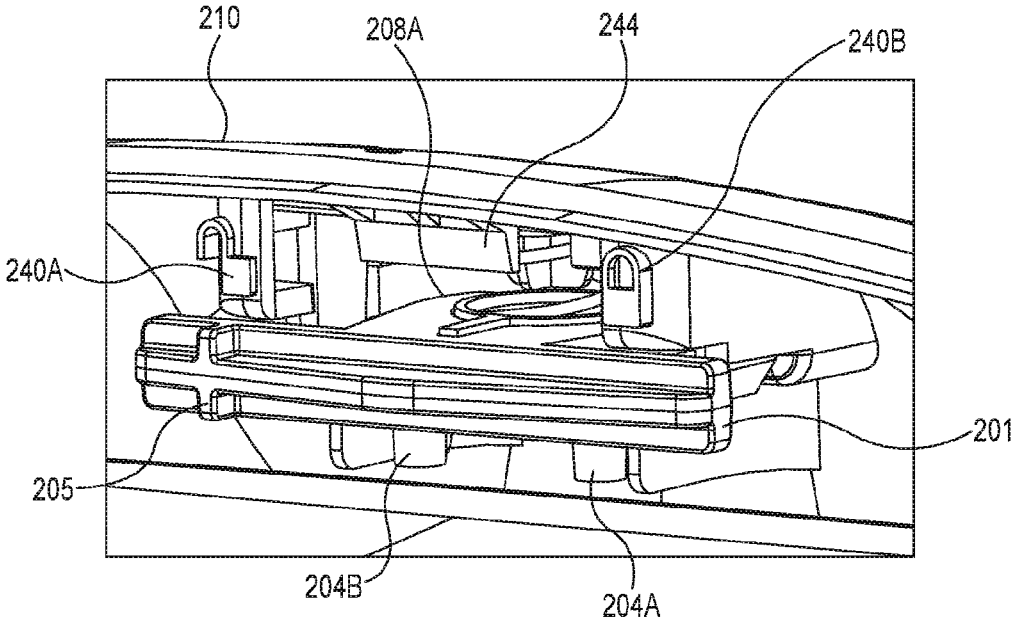
FIG. 17 is an interior perspective view of a housing showing example locking mechanism inserted into receiving area in an unlocking orientation.

FIG. 17 is an interior perspective view of a housing 210, showing example locking mechanism 202 inserted into receiving area 230 in an unlocking orientation. Orientation aligner 205 is aligned with orientation indicator 240A, indicating that locking mechanism 202 has been inserted in an unlocking configuration. As mentioned above, in the unlocking orientation, unlocking projections 208A and 208B are orientated toward pushbutton 250, and locking projections 206A and 206B and corresponding locking posts 204A and 204B, respectively, are oriented away from pushbutton 250.

Figure 18:
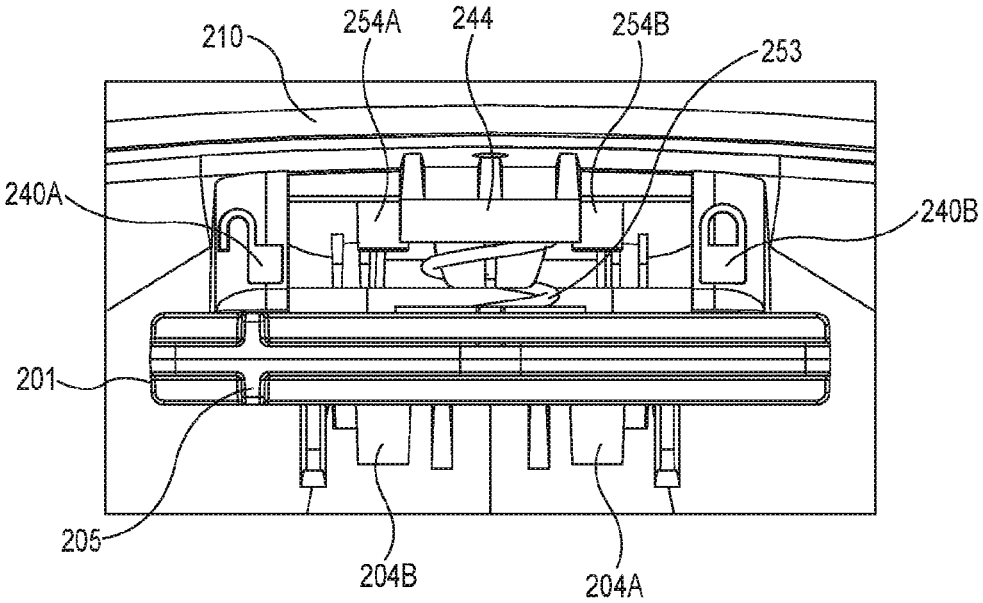
FIG. 18 is an interior front view of a housing showing example locking mechanism inserted into receiving area in an unlocking orientation.

FIG. 18 is an interior front view of a housing 210, showing example locking mechanism 202 inserted into receiving area 230 in an unlocking orientation. FIG. 18 shows downwardly extending projections 254A and 254B on bottom surface 253 of pushbutton 250 have enough space beneath them so that pushbutton 250 may be depressed.

Figure 19:
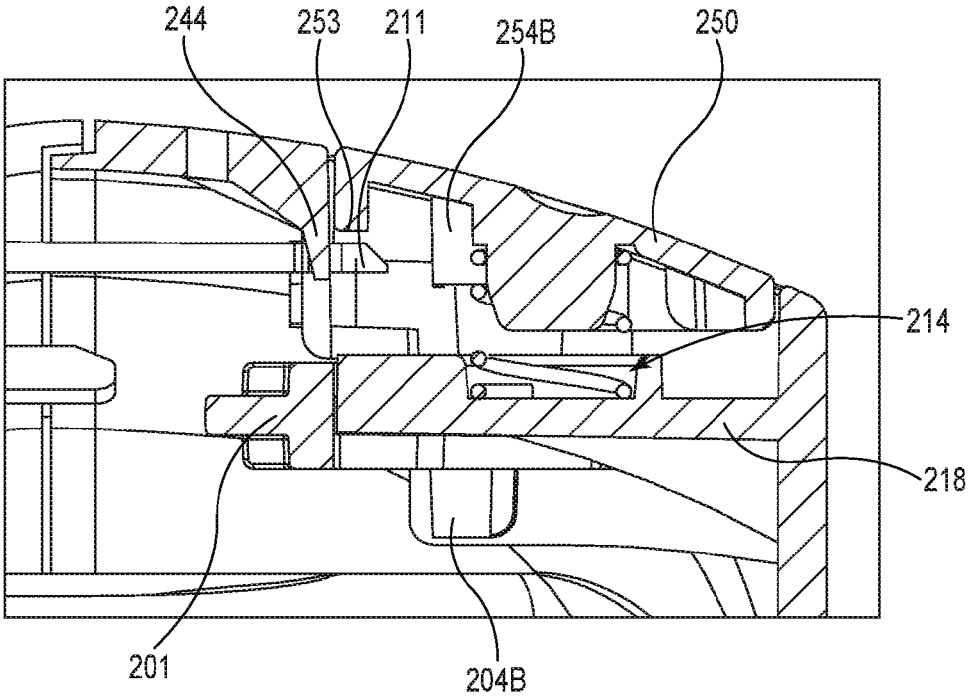
FIG. 19 is a side section view of an example housing showing a locking mechanism inserted into receiving area in an unlocking orientation.
Figure 20:
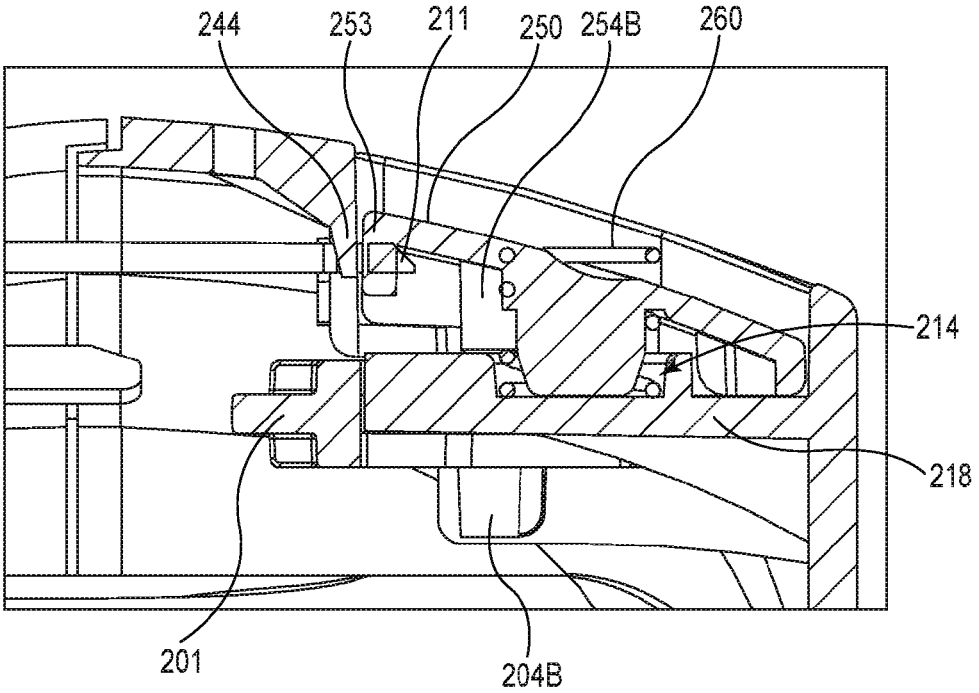
FIG. 20 is a side section view showing a lockable pushbutton in an actuated position.

FIG. 19 is a side section view of an example housing 210 showing a locking mechanism 202 inserted into receiving area 230 in an unlocking orientation. As with FIG. 18, FIG. 19 shows downwardly extending projections 254A and 254B on bottom surface 253 of pushbutton 250 have enough space beneath them so that pushbutton 250 may be depressed, as is shown in FIG. 20. In FIG. 20, actuation surface 253 of pushbutton 250 depresses a latch 211 within housing 210, releasing catch 244, and allowing housing 210 to be opened.

Figure 21:
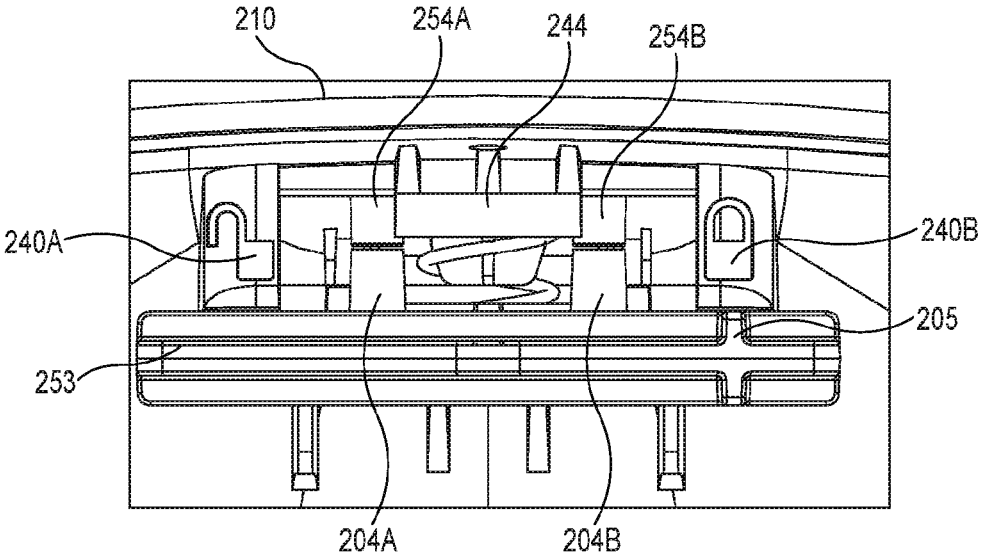
FIG. 21 is an interior front view of a housing showing example locking mechanism inserted into receiving area in a locking orientation.

FIG. 21 is an interior front view of a housing 210, showing example locking mechanism 202 inserted into receiving area 230 in a locking orientation. Orientation aligner 205 is aligned with orientation indicator 240B, indicating that locking mechanism 202 has been inserted in a locking orientation. In this orientation, locking posts 204A and 204B are positioned toward pushbutton 250 such that locking posts 204A and 204B align with downwardly extending projections 254A and 254B, respectively, of bottom surface 253 of pushbutton 250. In this orientation, locking posts 204A and 204B prevent actuation of pushbutton 250, thus providing the locking feature for a lockable pushbutton.

Figure 22:
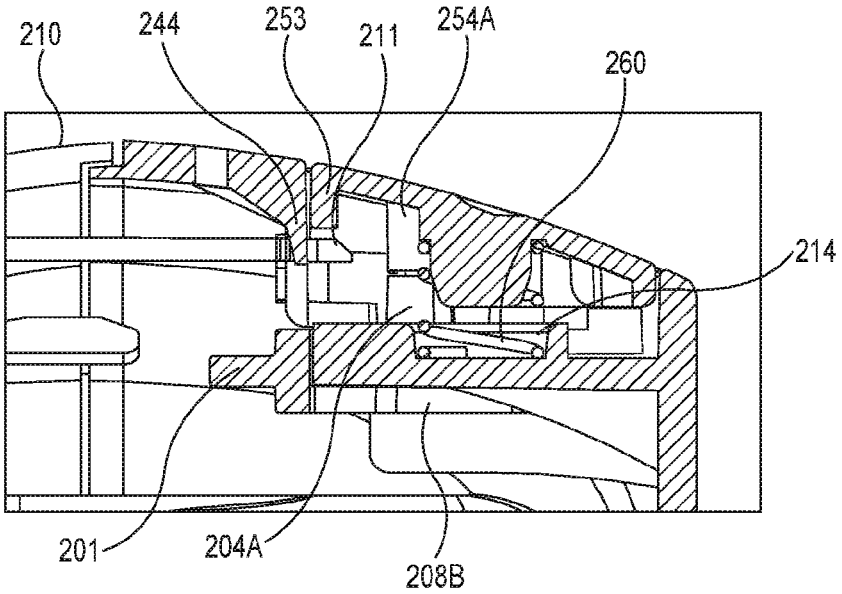
FIG. 22 is a side section view of an example housing showing a locking mechanism inserted into receiving area in a locking orientation.

FIG. 22 is a side section view of an example housing 210 showing a locking mechanism 202 inserted into receiving area 230 in a locking orientation. As with FIG. 21, locking posts 204A and 204B are positioned toward pushbutton 250 such that locking posts 204A and 204B align with downwardly extending projections 254A and 254B, respectively, of bottom surface 253 of pushbutton 250. Locking posts 204A and 204B are thus in a position to prevent actuation of pushbutton 250, thus providing the locking feature for a lockable pushbutton.

In the examples shown in FIGS. 13-22, a key may be inserted into a keyhole 242 (see, e.g., FIGS. 13 and 14) to unlock the housing when the reversible locking mechanism 202 is in the locked orientation, similarly to that described above with respect to FIGS. 6 and 10.

Although specific examples of a lockable pushbutton, locking mechanisms for a lockable pushbutton have been described, it shall be understood that other variations of lockable pushbuttons and locking mechanisms may also be used without departing from the spirit and scope of the present disclosure. In addition, although the lockable pushbutton and locking mechanisms are described herein with respect to a hand soap dispenser, it shall further be understood that the lockable pushbutton and locking mechanisms such as those described herein may also be used in other applications in which a lockable pushbutton may be desired. Those of skill in the art will readily appreciate that many alternative designs may be used, and that the disclosure is not limited in this respect.

Various examples have been described. These and other examples are within the scope of the following claims.

The invention claimed is:

1. A lockable pushbutton, comprising:

a locking mechanism body having a locked orientation and an unlocked orientation, the locking mechanism body further including:

a base portion having a front side and a back side;

two spaced apart locking projections extending outwardly from the back side of the base portion, and each including an associated locking post; and two spaced apart unlocking projections extending outwardly from the back side of the base portion substantially parallel with the locking projections;

a locking mechanism receiving area sized to receive the locking mechanism body in either the locked orientation or the unlocked orientation; and an actuatable pushbutton;

such that when the locking mechanism body is received into the locking mechanism receiving area in the locked orientation, the locking mechanism body prevents actuation of the pushbutton, and when the locking mechanism body is received into the locking mechanism receiving area in the unlocked orientation, the locking mechanism permits actuation of the pushbutton.

2. The lockable pushbutton of claim 1, wherein when the locking projections are oriented toward the pushbutton, the locking posts prevent actuation of the pushbutton.

3. The lockable pushbutton of claim 1, wherein when the unlocking projections are oriented toward the pushbutton, the unlocking projections permit actuation of the pushbutton.

4. A dispenser, comprising:

a housing including a back plate and an openable front cover;

a container inside of the housing having a supply of fluid to be dispensed;

a dispensing actuator that when actuated by a user results in a quantity of the fluid being dispensed from the container;

a locking mechanism body having a locked orientation and an unlocked orientation, the locking mechanism body further including:

a base portion having a front side and a back side;

two spaced apart locking projections extending outwardly from the back side of the base portion, and each including an associated locking post; and two spaced apart unlocking projections extending outwardly from the back side of the base portion substantially parallel with the locking projections;

the housing further including a locking mechanism receiving area positioned inside of the housing and sized to receive the locking mechanism body in either the locked orientation or the unlocked orientation; and a lockable pushbutton that upon actuation depresses a latch inside of the housing thus allowing the front cover to be opened;

such that when the locking mechanism body is received into the locking mechanism receiving area in the locked orientation, the locking mechanism body prevents actuation of the pushbutton, and when the locking mechanism body is received into the locking mechanism receiving area in the unlocked orientation, the locking mechanism permits actuation of the pushbutton.

5. The dispenser of claim 4 wherein the fluid comprises at least one of a lotion, a hand soap, a sanitizer, or a cleaning agent.

6. The dispenser of claim 4, wherein when the locking projections are oriented toward the pushbutton, the locking posts prevent actuation of the pushbutton.

7. The dispenser of claim 4, wherein when the unlocking projections are oriented toward the pushbutton, the unlocking projections permit actuation of the pushbutton.

8. The dispenser of claim 4 wherein the dispensing actuator comprises a manual or an automatic dispensing actuator.

* * * * *